US005181470A

United States Patent [19]

Barrois et al.

[11] Patent Number: 5,181,470

[45] Date of Patent: Jan. 26, 1993

[54] INKING UNIT WASHING ASSEMBLY

[75] Inventors: Claus D. Barrois, Erlenbach; Philipp A. Dieterich, Randersacker, both of Fed. Rep. of Germany

[73] Assignee: Koenig & Bauer Aktiengesellschaft, Wurzburg, Fed. Rep. of Germany

[21] Appl. No.: 904,031

[22] Filed: Jun. 25, 1992

[30] Foreign Application Priority Data

Jun. 26, 1991 [DE] Fed. Rep. of Germany ..... 4121017

[51] Int. Cl.[5] ..... B41F 35/04; B41F 31/20

[52] U.S. Cl. ..... 101/425

[58] Field of Search ..... 101/425, 423, 424; 118/70, 203, 204, 245, 244, 258; 15/82, 88.2

[56] References Cited

U.S. PATENT DOCUMENTS 3,850,099 10/1973 Laben ..... 101/425 X
3,976,007 8/1976 Junghans ..... 101/425
4,344,362 8/1982 Ishii ..... 101/425
4,790,243 12/1988 Grosshauser ..... 101/147

FOREIGN PATENT DOCUMENTS 0251004 6/1987 European Pat. Off. .
1561008 11/1966 Fed. Rep. of Germany .
1961614 12/1969 Fed. Rep. of Germany .
2344573 9/1973 Fed. Rep. of Germany .
2851233 11/1978 Fed. Rep. of Germany .
7933305 11/1979 Fed. Rep. of Germany .
3109630 3/1981 Fed. Rep. of Germany .

*Primary Examiner*—J. Reed Fisher
*Attorney, Agent, or Firm*—Jones, Tullar & Cooper

[57] ABSTRACT

An inking unit washing assembly utilizes a pair of cooperating rollers in a housing. A first one of these rollers has a polygonal surface and engages a second, rubber cylinder which, in turn is in contact with a roller or drum of the inking unit to be cleaned. A washing solution is sprayed onto the polygonal roller after having been transferred to and back from the ink roller or drum to be cleaned.

9 Claims, 4 Drawing Sheets

INKING UNIT WASHING ASSEMBLY

FIELD OF THE INVENTION

The present invention is directed generally to a washing assembly for an inking unit. More particularly, the present invention is directed to a washing assembly for an inking unit in a printing press. Most specifically, the present invention is directed to a washing assembly for inking units which utilizes a movable housing that is positionable adjacent an inking unit to be washed. The housing carries a rubber roller and a polygonal roller. A plurality of spray jets contact the surface of the polygonal roller and rinse ink and debris from its surface. The rubber roller in the housing is placed in contact with the ink distribution roller of the inking unit to be cleaned. It carries cleaning fluid to the distribution roller and removes cleaning fluid and entrained materials from the surface of the ink distribution roller of the inking unit.

DESCRIPTION OF THE PRIOR ART

Inking units in various printing presses periodically must be cleaned or washed to remove ink residue, paper particles and accumulated dust as well as any other substances which may become attached to the surface of the ink distribution roller or drum and which will result in an incomplete transfer of the ink from the ink distribution drum or drums to the forme rollers.

In prior art devices, the cleaning of an inking unit has typically been accomplished by positioning a doctor blade against the surface of a driven ink roller and to apply a washing solution to the ink roller in the inking unit which is the furthest distance from the doctor blade. The doctor blade removes the wash solution from the surface of the ink roller in the inking unit being cleaned by scraping the wash solution from the surface of the ink roller with which it is in contact.

A primary consideration with inking unit washing and cleaning assemblies is that they also be easy to maintain. In the German published examined patent application No. 23 44 573 there is shown a washing device for use in the cleansing of a fluid inking unit. In this prior art device, there are arranged jet tubes above and below the doctor blade that is engageable with the ink roller to be cleaned. These jet tubes and doctor blade are used to remove the ink or ink residue from the forme roller. A limitation of this prior art device is that the doctor blade does not have a uniform impression pressure against the roller to be cleaned along the axial length of the roller. This means that the doctor blade does not bear uniformly against the roller along its entire length. The doctor blade may thus try to float when there is too much cleaning or washing fluid supplied to it. This results in non-uniform cleaning of the roller. Also if the supply of cleansing or washing fluid is cut off and the doctor blade is caused to run dry, there are apt to be furrows or grooves formed on the surface of the roller to be cleaned.

In the German published unexamined patent application No. 31 09 630 there is shown an inking unit cleaning assembly in which an attempt is made to apply a uniform pressure along the axial length of the doctor blade. This is accomplished by providing the doctor blade with a springy or resilient support. A device of this type is apt not to be able to apply sufficient pressure to adequately remove the materials to be cleaned from the surface of the ink roller.

These ink roller surface contaminants, such as ink residue and paper dust can not be completely removed by a doctor blade since the working edge of the doctor blade has a front surface instead of a cutting edge. The result of this is that when the cleansing procedure has been completed and the doctor blade is being removed from the roller to be cleaned, there will be at least one half of the deposit left on the roller surface. This line of non-removed material must be removed from the ink roller surface by other suitable means.

It will be apparent that a need exists for an inking unit washing device which overcomes the limitations of the prior art devices and which will thoroughly clean the surface of the ink distribution roller or the like without damaging the surface of the roller. The inking unit washing assembly of the present invention provides such a device and is a significant improvement over the prior art devices.

SUMMARY OF THE INVENTION

It is an object of the present invention to provide an inking unit washing assembly.

Another object of the present invention is to provide an inking unit washing assembly for a printing machine.

A further object of the present invention is to provide an inking unit washing assembly which operates without doctor blades.

Yet another object of the present invention is to provide an inking unit washing assembly which utilizes a rubber roller to contact the roller to be cleaned.

Still a further object of the present invention is to provide a washing device for inking units of a printing press which is nearly maintenance-free.

Even yet another object of the present invention is to provide a washing device for inking units which has a high cleaning capacity and does not have the destructive secondary effects of doctor blades.

As will be discussed in greater detail in the description of the preferred embodiments which are set forth subsequently, the inking unit washing assembly in accordance with the present invention utilizes a housing that can be positioned on the printing unit adjacent any inking unit roller that is to be cleaned. A rubber roller and a polygonal roller are rotatably supported in the housing. A pair of spray jet bars supply a cleansing or washing fluid to the polygonal roller which, in turn, transfers the washing fluid to the roller to be cleaned by way of the rubber roller. The rubber roller also removes from the roller being cleaned washing fluid with entrained ink residue and the like. This contaminated washing fluid is carried by the rubber roller back into the housing where it is removed by the polygonal roller. The contaminated washing fluid is then sprayed off the polygonal roller and can be processed for re-use.

A particular advantage of the inking unit washing assembly of the present invention is that it is very thorough and complete in its cleaning of the ink roller. Even the last ink deposits are removed from the surface of the ink roller to be cleaned since squeezing is avoided. Since the washing assembly of the present invention uses rotary parts, the destructive secondary effects of the prior art doctor blade devices are avoided. This means that the furrows or grooves which were formed in the surface of the ink roller when the prior art doctor blade type cleaning unit was used are avoided.

The inking unit washing assembly of the present invention is essentially maintenance free since there are no doctor blades to be cleaned of adhering ink deposits.

The rollers in the housing of the assembly are essentially self cleaning and the ink residue and the like are flushed off the rollers and removed from the washing fluid.

The washing assembly of the present invention can be positioned to contact any desired one or ones of the distributive rollers in a typical inking unit. The rubber roller and its cooperating polygonal roller can be rotated in any desired direction so that the rubber roller can engage an ink distribution roller in the inking unit regardless of its direction of rotation.

The inking unit washing assembly in accordance with the present invention overcomes the limitations of the prior art devices and provides an assembly which is a substantial advance in the art.

BRIEF DESCRIPTION OF THE DRAWINGS

While the novel features of the inking unit washing assembly in accordance with the present invention are set forth with particularity in the appended claims, a full and complete understanding of the invention may be had by referring to the detailed description of the preferred embodiments, which are set forth subsequently, and as illustrated in the accompanying drawings in which:

DESCRIPTION OF THE PREFERRED EMBODIMENTS

Figure 1:
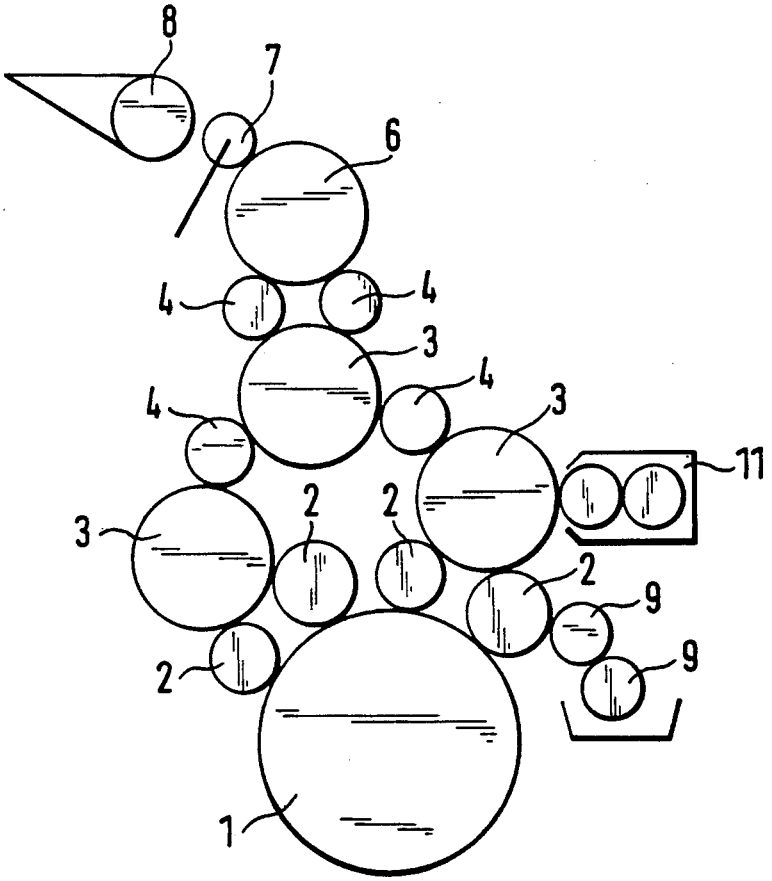
FIG. 1 is a schematic side elevation view of a printing unit and inking unit with the washing assembly of the present invention.

Referring initially to FIG. 1 there may be seen a generally schematic depiction of an inking unit for a printing machine in which the inking unit washing assembly of the present invention may be beneficially utilized. The printing unit includes a plate cylinder 1 which is contacted by four forme rollers 2 that are positioned about the periphery of the plate cylinder 1. An ink distribution drum 3 is in ink transfer contact with each two of the forme rollers 2. These two ink distribution drums 3 are also in ink transfer contact with a third ink distributor drum 3 through two intermediate rollers 4. Two further intermediate rollers 4 are in ink transfer contact with an ink distribution roller 6 that is engaged by an ink vibrator roller 7. An ink duct roller 8 transfers ink from an ink fountain or duct to the vibrator roller 7. A dampening unit, generally at 9 is in contact with one of the forme rollers 2. An inking unit washing assembly, generally at 11, in accordance with the present invention is depicted in FIG. 1 as being in contact with one of the ink distributor drums 3 which is in contact with two of the forme rollers 2.

It will be understood that the inking unit washing assembly 11 can be positioned to contact any one of the rollers in the printing unit depicted in FIG. 1 which is to be cleaned. It will also be understood that the specific configuration of ink distributor drums 3, forme rollers 2, intermediate rollers 4 and distributor roller 6 and associated vibrator roller 7 and duct roller 8 depicted in FIG. 1 are exemplary of a number of generally known inking unit arrangements with which the present invention may be utilized. It will further be understood that the various side frames, roller bearing supports, and other holding and supporting assemblies for these cylinders and the washing assembly are not specifically depicted since they do not form a part of the present invention.

Figure 2:
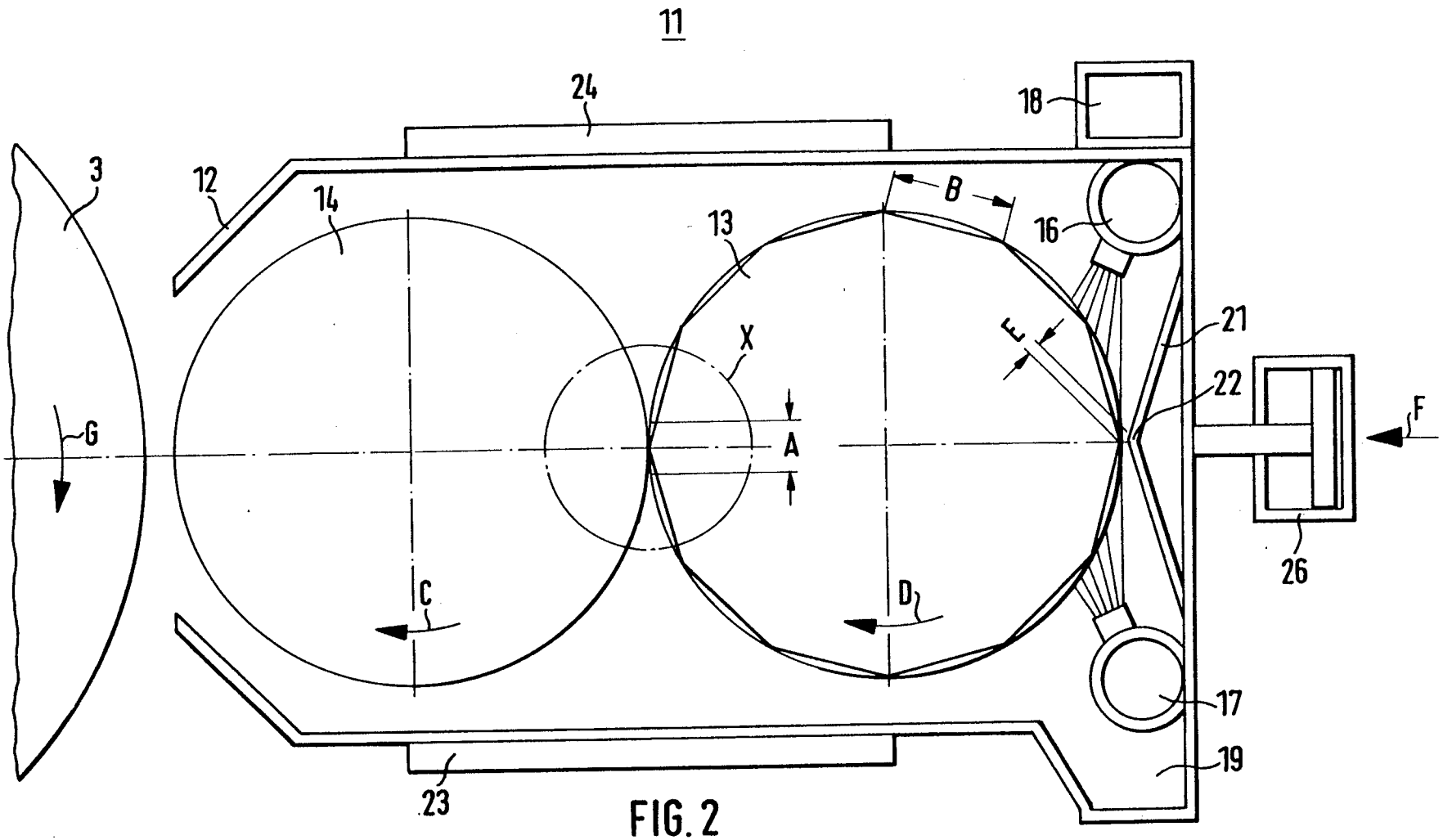
FIG. 2 is a side elevation view of a first preferred embodiment of the inking unit washing assembly of the present invention.

Turning now to FIG. 2, there may be seen a first preferred embodiment of an inking unit washing assembly 11 in accordance with the present invention. A housing 12, which is generally U-shaped in cross-section, and which has an open mouth portion, rotatably supports a pair of cooperating rollers. A first inner roller 13 has a surface which is generally polygonal in cross-section and that has a plurality of axially extending, generally flat surface portions B. These flat surfaces B have an axially extending twist. The inner polygonal roller 13 engages the surface of a second, outer roller 14 which has a rubber surface. Both of these rollers, 13 and 14, are rotatably supported in the housing 12 by support of their axle necks in suitable bearings or the like. The spacing between rollers 13 and 14 is selected so that the peripheral surface of the polygonal roller 13 impresses into the surface of the rubber roller 14 over a contact area A, as may be seen more clearly in FIG. 3. The rubber roller 14 is provided with a rubber or other resilient surface coating that has a maximum hardness of 15° Shore. The polygonal roller 13 has a plastic coating on its surface.

Figure 3:
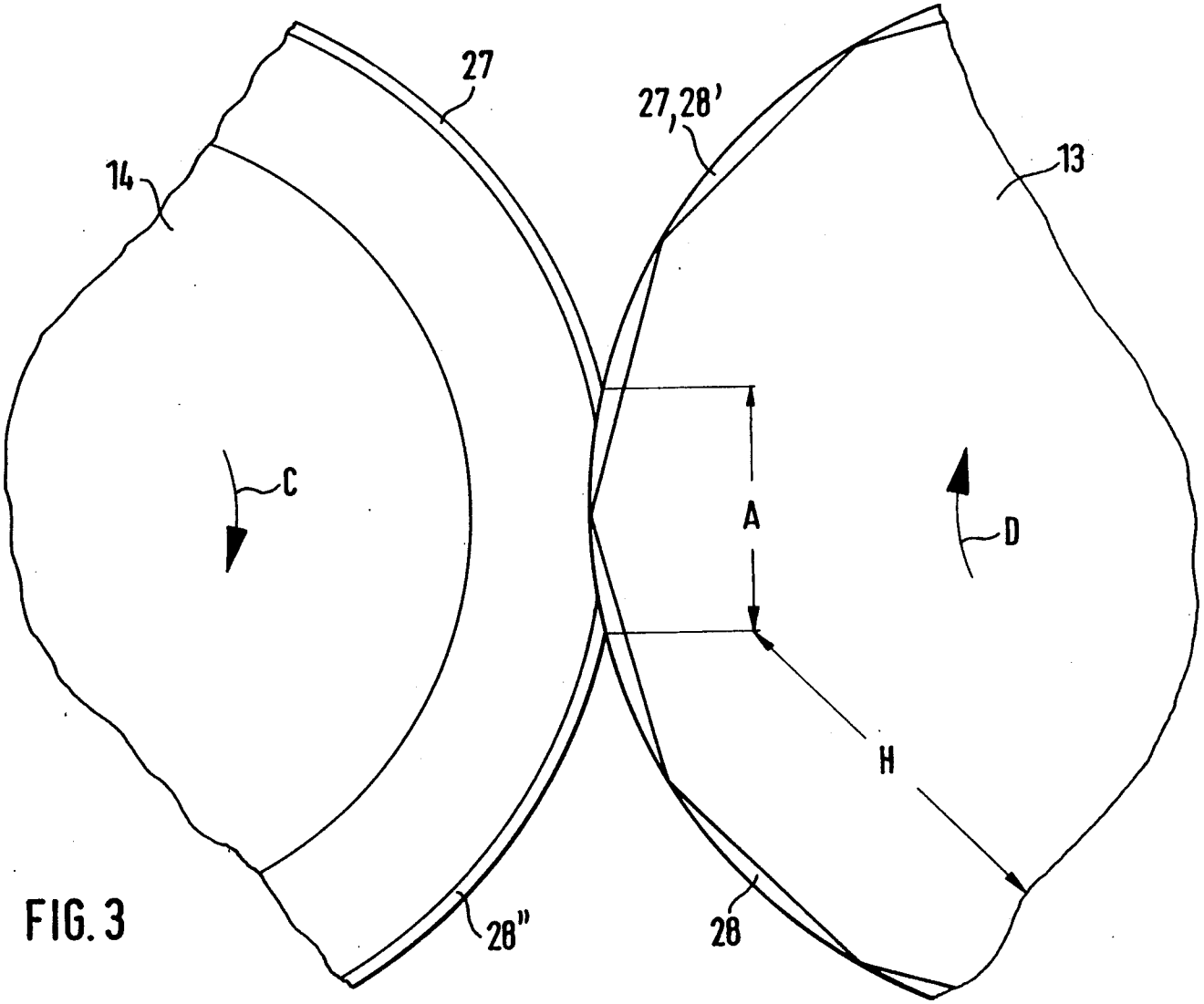
FIG. 3 is an enlarged side elevation view of the encircled portion of the washing assembly taken at X in FIG. 2.

The rubber roller 14 is caused to be driven for rotation in the direction indicated by arrow C in FIGS. 2 and 3. A speed controllable or adjustable motor which is not specifically shown may be employed to drive rubber roller 14 in a desired direction of rotation at a desired speed. The polygonal roller 13, which has the plurality of twisting, axially extending flat surfaces B, is also driven for rotation by a suitable drive means, such as a toothed belt with the same speed as the rubber roller 14 but in the opposite direction of rotation, as indicated by arrow D. The axially extending twisted surfaces B on the polygonal roller 13 result in a quieter running contact of the rollers 13 and 14. The drive of these two rollers can be regulated so that the rotational speed, and thus the peripheral speed of roller 13 can be greater or less than the peripheral speed of the rubber roller 14. An upper jet spray bar 16 and a lower jet spray bar 17 extend axially across the inner end of the housing 12 at the end of the housing away from its mouth. These jet spray bars 16 and 17 extend parallel to the axes of the polygonal roller 13 and the rubber roller 14. Each of the spray jet bars 16 and 17 has a plurality of jet spray nozzles which are used to direct sprays of a wash solution onto the surface of the polygonal roller 13. The wash solution is supplied to the spray jet bars 16 and 17 from a wash solution feed conduit 18 that extends across the top of the housing 12. The two spray jet bars 16 and 17 produce generally flat sprays of the washing solution which engage spaced ones of the axially extending flat surfaces B of the polygonal roller 13.

A wash solution drainage sump 19 is placed at the lower inner end of the housing. This drainage sump 19 receives wash solution that runs off the polygonal roller 13 and carries with it entrained ink residue, paper dust and other contaminants that have been removed from the ink distributor drums 3 with which the washing assembly 11 is brought into engagement. A suitable reservoir and pump, which are not specifically shown, are connected between the wash solution discharge sump 19 and the wash solution feed conduit 18. The entrained impurities can be removed from the wash solution so that it can be re-used.

A generally triangular or roof-shaped splash plate 21 is secured to the inner wall of the housing 12 and extends axially between the upper and lower spray jet bars 16 and 17. The apex or ridge 22 of this splash plate 21 is generally at the same level as the axes of rotation of the polygonal roller 13 and the rubber roller 14. There is thus a small space E between the ridge 22 of the splash plate 21 and the surfaces B of the polygonal roller 13. This ensures that the polygonal roller 13 will be thoroughly wetted with, and rinsed by the wash solution which emanates from the spray jet bars 16 and 17.

The housing 12 of the inking unit washing assembly 11 of the present invention is slidably shiftable toward and away from a distributor drum 3 or the like into which the surface of the rubber roller 14 will be brought for cleaning engagement. This is accomplished by providing the housing 12 with lower and upper guides 23 and 24 which will engage suitable slide holders in the printing unit frame. A piston assembly generally at 26 is engageable with the rear or inner wall of the housing 12 so that the housing can be moved in the direction indicated by the arrow F toward or away from a distributor drum 3 that is to be cleaned.

Turning now to FIG. 3 there is depicted, on an enlarged scale, the area of contact between the polygonal plastic roller 13 and the rubber roller 14. The surfaces B of the polygonal roller 13 are provided with a coating 28 of fresh washing solution from the spray jet bars 16 and 17 generally in the portions H of the polygonal roller 13, as seen in FIG. 3. In the contact area A between the polygonal roller 13 and the rubber roller 14, the surfaces and edges of the polygonal roller 13 press into the surface of the rubber roller 14. The ink film 27 that was transferred from distributor drum 3 and which is now adhering on the rubber roller 14 is moved, due to the rubber roller 14 rotating in the direction of arrow C, in the contact area A against the edges of the polygonal roller 13. In the contact area A there is formed a mixture of the ink film 27 with the wash-up solution 28 that was supplied by the polygonal roller 13. Since the surfaces B on the periphery of the polygonal roller 13 run in a coaxial direction with a twist, there is provided a stirring effect, which dissociates even more the ink film 27 from the rubber roller 14 in the area A. With a further rotation of the rollers 13 and 14 in their indicated directions of rotation C and D, a surface B comes into contact with the rubber roller 15 in the area A. This has a crushing effect on rubber roller 14. With a further rotation of the rollers 13 and 14, the mixture consisting of parts of the ink film 27 and of the wash-up solution 28', is sheared off the roller 14 and this mixture is transported away on the polygonal roller 13 in the direction of arrow D. This mixture 27 and 28' is then sprayed off from the surface of the polygonal roller 13 by means of the spray jet bars 16 and 17 and is led through the wash-up solution drainage 19 to the filtration system and is then again fed to the jet bars 16 and 17 by means of a pump. There is also interconnected a reservoir, which is, like the pump and filtration, not specifically shown in the drawings.

As may be seen in FIG. 2, the direction of rotation of the distributor drum 3, as indicated by arrow G, is opposite to the direction of rotation C of the rubber roller 14. This results in a more complete transfer of washing fluid from roller 14 to drum 3 and a more complete pick up of cleaning or washing fluid and entrained ink residue and the like from the distribution drum 3 to the rubber roller 14. As was discussed previously, the directions of rotation of the rubber roller 14 and the polygonal roller 13 can be reversed if the direction of rotation of the distribution drum 3 is reversed. The wash solution 28" applied to the rubber roller 14 from the polygonal roller 13, as seen in FIG. 3 is also more effectively accomplished because of the opposing directions of rotation of the rollers 13 and 14, as indicated by the arrows D and C, respectively.

Figure 4:
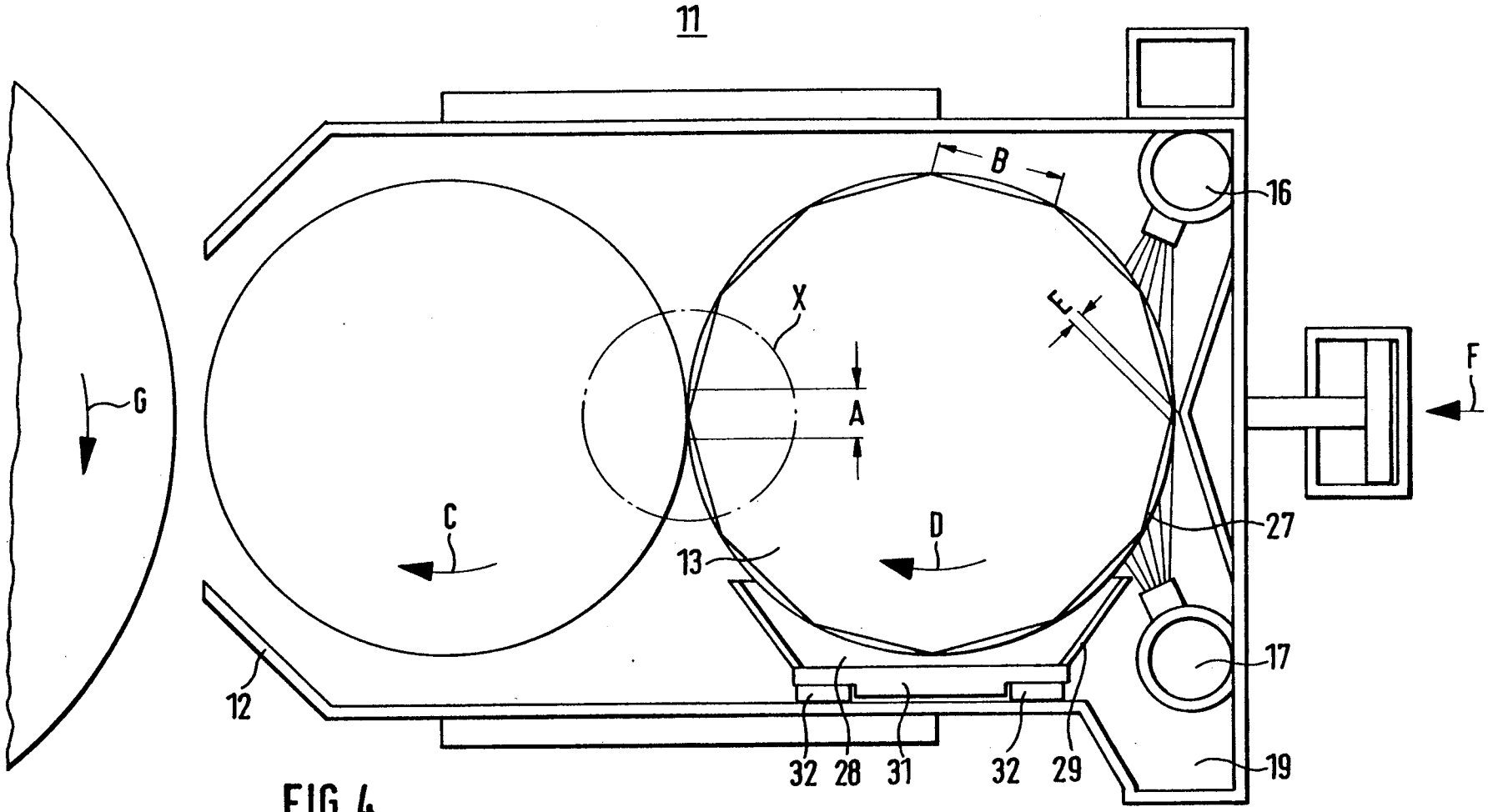
FIG. 4 is a side elevation view of a second preferred embodiment of the inking unit washing assembly of the present invention.

Referring now to FIG. 4, there may be seen a second preferred embodiment of an inking unit washing assembly in accordance with the present invention. In this second preferred embodiment there is arranged a pan 29 filled with washing solution 28, with the pan 29 being situated below the polygonal roller 13 and within the housing 12 so that the polygonal roller 13 is immersed in the washing solution 28 in the pan. The pan 29 is connected at its bottom with a vibration generator 31. The vibration generator 31 rests on vibration insulators 32, which are connected with the bottom of the housing 12. The vibration generator 31 works in the ultrasonic range and removes any ink deposits which may possibly still exist on the polygonal roller 13. The pan 29 becomes filled with washing solution 28 and with ink residue 27 from the spray jet bars 16 and 17, or from the polygonal roller 13. The fluid in the pan 29 overflows automatically and is then returned by the washing solution drainage sump 19 to the washing solution circuit so that the washing fluid 28 may be cleaned of ink residue 27 and other impurities which have been removed from the surface of the ink distributor drum 3 into which the washing assembly 11 has been brought into contact.

While preferred embodiments of an inking unit washing assembly in accordance with the present invention has been set forth fully and completely hereinabove, it will be apparent to one of skill in the art that a number of changes in, for example the specific configuration of the printing unit, the sizes of the various rollers, the type of washing solution used and the like may be made without departing from the true spirit and scope of the present invention which is accordingly to be limited only by the following claims.

What is claimed is:

1. An inking unit washing assembly which is usable to remove ink residue and other contaminants from an ink distribution drum of an inking system for a printing press, said inking unit washing assembly comprising:

a housing supported for movement on the printing press;

a first polygonal roller and a second rubber roller supported for rotation in said housing, said first and second rollers being generally parallel and in contact with each other, said first polygonal roller having a plurality of axially extending flat surfaces, said plurality of flat surfaces being twisted with respect to the axis of rotation of said first polygonal roller;

means to move said housing with respect to said ink distribution drum to be cleaned to engage said second roller with said ink distributor drum to be cleaned; and means to supply a washing solution to said first polygonal roller and to remove said washing solution and entrained contaminants from said first, polygonal roller.

2. The inking unit washing assembly of claim 1 wherein said means to supply a washing solution to said first polygonal roller includes at least a first spray jet bar having a plurality of spray jets in said housing.

3. The inking unit washing assembly of claim 1 wherein said polygonal roller and said rubber roller are driven for rotation in opposing directions.

4. The inking unit washing assembly of claim 1 wherein said second, rubber roller has a maximum hardness of 15° Shore.

5. The inking unit washing assembly of claim 2 further including a splash plate in said housing generally adjacent said first, polygonal roller, said at least first spray jet bar being positioned adjacent said splash plate.

6. The inking unit washing assembly of claim 1 wherein said means to move said housing includes spaced housing guides which slidingly support said housing and further includes a piston to shift said housing.

7. The inking unit washing assembly of claim 1 wherein said means to supply said washing fluid to said first polygonal roller includes a pan positioned in said housing beneath said polygonal roller, said pan receiving said washing solution, a surface of said polygonal roller immersing in said pan.

8. The inking unit washing assembly of claim 7 wherein said pan is provided with a vibration generator and is supported in said housing by vibration insulators.

9. The inking unit washing assembly of claim 8 wherein said vibration generator is operable in the ultrasonic range.

* * * * *